US005931700A

United States Patent [19]

Saito et al.

[11] Patent Number: 5,931,700

[45] Date of Patent: Aug. 3, 1999

[54] CONNECTOR EQUIPPED WITH AN INSERTION DETECTING MEMBER FOR TERMINAL LUGS

[75] Inventors: Hitoshi Saito; Kazuto Ohtaka; Hitoshi Sakai; Hisashi Hanazaki; Yoshimi Wada, all of Shizuoka, Japan

[73] Assignee: Yazaki Corporation, Tokyo, Japan

[21] Appl. No.: 08/795,407

[22] Filed: Feb. 5, 1997

Related U.S. Application Data

[63] Continuation-in-part of application No. 08/597,288, Feb. 6, 1996, Pat. No. 5,722,857.

[30] Foreign Application Priority Data

Feb. 6, 1995 [JP] Japan ..... 7-17809
Feb. 5, 1996 [JP] Japan ..... 8-019113

[51] Int. Cl.[6] ..... H01R 13/40

[52] U.S. Cl. ..... 439/595; 439/489

[58] Field of Search ..... 439/595, 488, 439/489

[56] References Cited

U.S. PATENT DOCUMENTS 4,946,398 8/1990 Takeunouchi et al. ..... 439/595
5,071,369 12/1991 Denlinger et al. ..... 439/595
5,145,419 9/1992 Yamanashi et al. ..... 439/595
5,292,261 3/1994 Hirano et al. ..... 439/595

FOREIGN PATENT DOCUMENTS 4426 624 A 1 3/1995 Germany .
4-55765 5/1992 Japan .

*Primary Examiner*—Steven L. Stephan
*Assistant Examiner*—T C Patel
*Attorney, Agent, or Firm*—Armstrong, Westerman, Hattori, McLeland & Naughton

[57] ABSTRACT

A connector housing has a body portion and a hood portion. An insertion detecting member for terminal lugs is movable from provisional locking position to full locking position inside the hood portion. A resilient, terminal-lug locking piece extends in each terminal accommodating cavity in the housing body portion to form a displacement permitting space on a side opposite a side where a terminal lug is inserted. The insertion detecting member has a main frame, insertion detectors corresponding to the displacement permitting spaces, and a pair of manipulating portions at opposite sides of the main frame. When in provisional locking position the manipulating portions are exposed at opposite sides of the housing body portion, and when in full locking position the insertion detectors move into the displacement permitting spaces. The insertion detecting member is easily movable from provisional locking position to full locking position inside the housing hood portion.

4 Claims, 10 Drawing Sheets

CONNECTOR EQUIPPED WITH AN INSERTION DETECTING MEMBER FOR TERMINAL LUGS

This application is a continuation-in-part application of U.S. patent application Ser. No. 08/597,288, filed Feb. 6, 1996 (now U.S. Pat. No. 5,722,857).

BACKGROUND OF THE INVENTION

1. Field of the Invention

The present invention relates to a connector equipped with an insertion detecting member for terminal lugs (terminal metal parts) which is capable of detecting incomplete insertion of terminal lugs.

2. Description of the Related Art

In FIGS. 17 and 18, a is a female connector housing with a hood portion a1 at the front thereof, b is an insertion detecting member for a terminal lug. The insertion detecting member b is comprised of a pair of introduction portions b1, followed by a detecting portion b2. Insertion guide portions b3 are formed at both sides of the detecting portion b2 and a downwardly-directed arch-shaped manipulating portion b4 is provided on the underside of the introduction portions b1.

A pair of guide grooves d, d are formed at opposite positions on inner walls of the hood portion a1 of the female connector housing a. The insertion detecting member b is pressed into the hood portion a1, with the insertion guide portions b3, b3 engaged in the guide grooves d, d, so that the manipulating portion b4 protrudes to the outside through a window e formed from the hood portion a1 to a housing body portion a2 (refer to FIGS. 18 and 19).

FIG. 19 shows the insertion detecting member b in provisional locking position, in which a provisional locking projection f engages with the rear end of an engagement portion g of the female connector housing a. In provisional locking position, a terminal lug C is inserted into a terminal accommodating cavity a3 from the rear while displacing a resilient locking piece h downwardly into a displacement permitting space i. On completion of the insertion of the terminal lug C, the resilient locking piece h restores its original position to bring its locking projection h1 into engagement in a locking hole in the terminal lug C to lock the terminal lug in place. The insertion detecting member b is then pushed at the manipulating portion b4 into the female connector housing a to bring the detecting portion b2 into the displacement permitting space i and allow a full locking projection j to engage with the rear end of the engagement portion g. The insertion detecting member b is thus held in full locking position as shown in FIG. 20.

As shown in FIG. 21, if the terminal lug C is inserted incompletely, the terminal lug keeps the resilient locking piece h forcibly displaced into the displacement permitting space i, making it impossible for the insertion detecting member b to move into the displacement permitting space and thus into full locking position. It is thus detected that the terminal lug C has been inserted incompletely.

In the above related art, since guide grooves d, d are formed on inner walls of the hood portion a1, the hood portion is subject to deformations. If the hood portion walls are thickened around the guide grooves d, d to prevent these deformations, a disadvantage arises that their external dimensions become large. Further, since the arch-shaped manipulating portion b4 is employed which protrudes outside the female connector housing a, a large cutout is required in the area from the hood portion a1 to the housing body portion a2 to provide the window e. In addition, since the insertion detecting member b, which is engaged in the guide grooves d, is pushed into full locking position at the manipulating portion b4 provided protruding at one side of the detecting member b, the detecting member is subject to distortions during its moving operations, resulting in the detecting member being moved unsmoothly.

SUMMARY OF THE INVENTION

The present invention has been accomplished to overcome the above drawbacks and an object of the present invention is to provide a connector which is equipped with an insertion detecing member for terminal lugs, but still has a sufficient connector housing strenth, and which enables the insertion detecting member to be smoothly moved during its operations.

In order to attain the object, according to the present invention, there is provided a connector equipped with an insertion detecting member for terminal lugs, which comprises: a connector housing comprising a body portion and a hood portion provided at a front of the body portion; and an insertion detecting member for terminal lugs provided in the hood portion of the connector housing, the body portion of the connector housing having terminal-accommodating cavities formed therein, each having a resilient, terminal-lug locking piece projecting therein to form a resilient displacement permitting space on a side opposite a side where the terminal lug is inserted, the insertion detecting member comprising a main frame portion, insertion detectors corresponding to the resilient displacement permitting spaces, provided on the main frame portion, and a pair of manipulating portions provided at opposite sides of the main frame portion, the insertion detectors and the manipulating portions extending in a coupling direction of the insertion detecting member to the hood portion, wherein the insertion detecting member is movable from a provisional locking position to a full locking position inside the hood portion, with the main frame portion slided along inner surfaces of the hood portion, and wherein, in the provisional locking position, the pair of manipulating portions are exposed at opposite sides of the body portion of the connector housing through windows provided in the hood portion, and in the full locking position the insertion detectors move into the respective resilient displacement permitting spaces.

In the construction as mentioned above, fingers are put on the pair of manipulating portions exposed at opposite sides of the housing body portion and the insertion detecting member is moved from a provisional locking postion to a full locking position. In this instance, if any of the terminal lugs is inserted incompletely, the related resilient locking piece is displaced thereby into the resilient displacement permitting space. Consequently, the related one of the insertion detectors abuts against the displaced locking piece to disable the insertion detecting member from being further moved.

The above and other objects, features and advantages of the present invention will become apparent from the following description and the appended claims, taken in conjunction with the accompanying drawings in which like parts or elements are denoted by like reference characters.

DETAILED DESCRIPTION OF THE PREFERRED EMBODIMENTS

Figure 1:
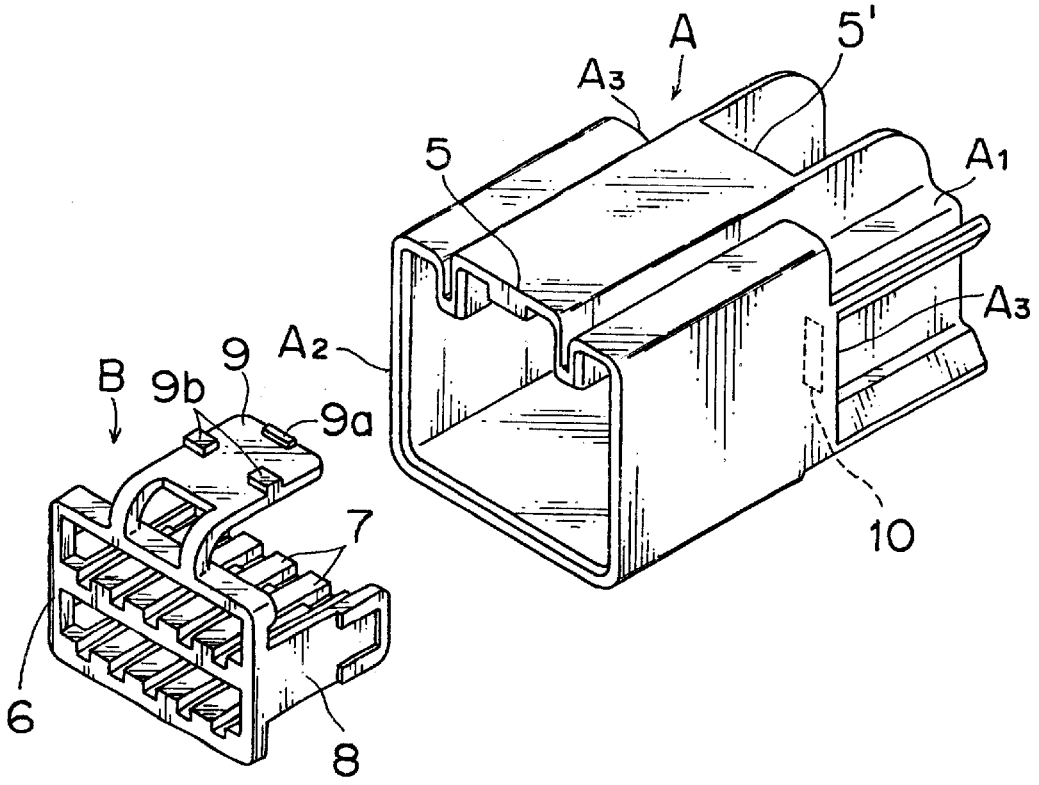
FIG. 1 is a perspective view of a connector and an insertion detecting member for terminal lugs according to one embodiment of the present invention, shown separated.
Figure 2A:
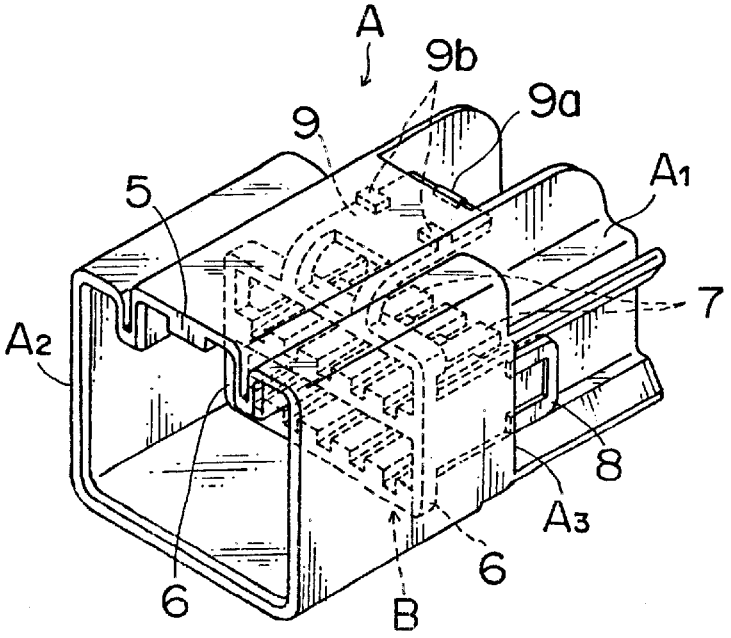
FIG. 2A is a perspective view of the insertion detecting member in a provisional locking position in the connector.
Figure 2B:
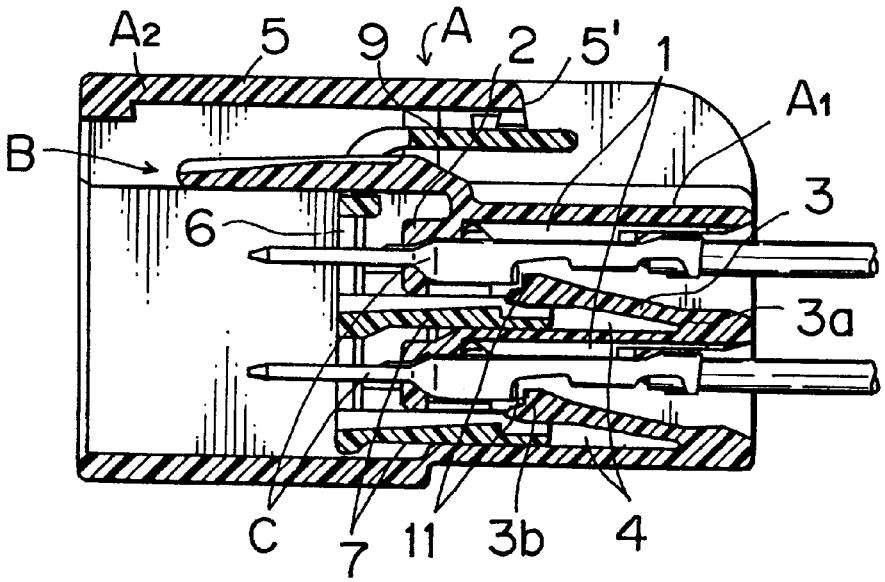
FIG. 2B is a sectional view taken along an insertion axis direction of FIG. 2A.
Figure 3A:
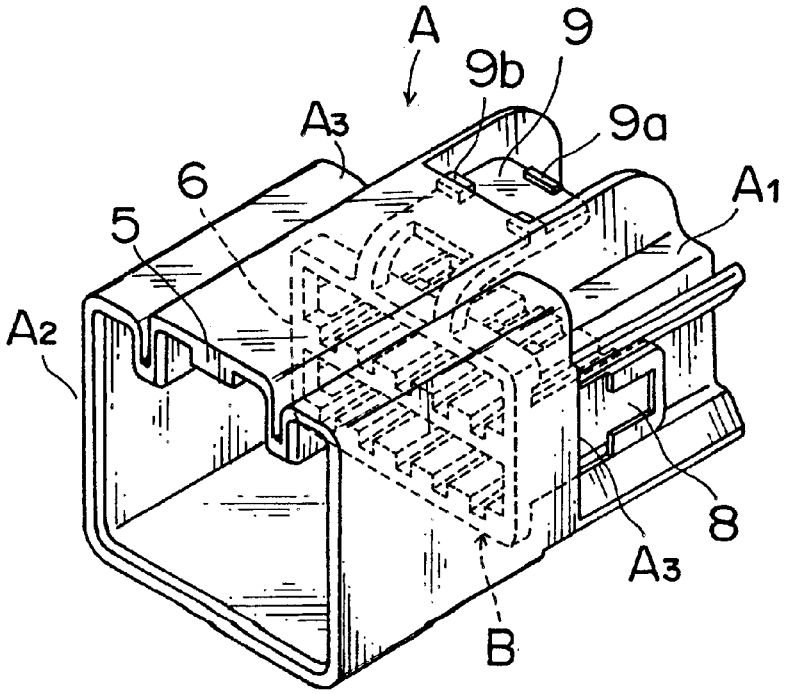
FIG. 3A is a perspective view of the insertion detecting member in its full locking position in the connector.
Figure 3B:
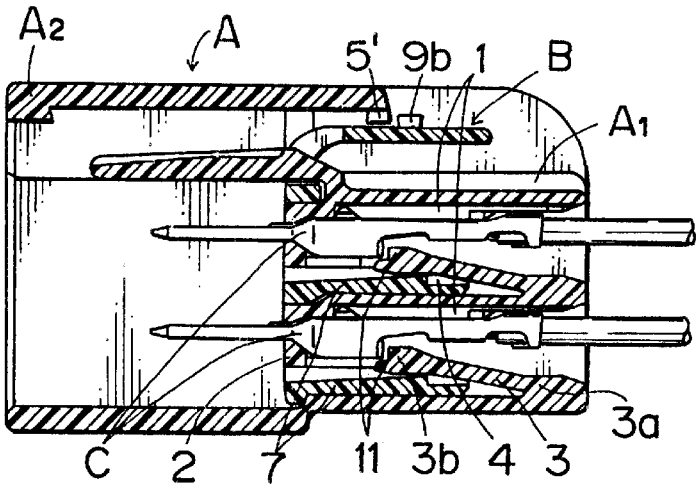
FIG. 3B is a sectional view taken along the insertion axis direction of FIG. 3A.

Embodiments of the present invention will now be described in detail referring to the accompanying drawings.

In FIGS. 1 to 3B, A is a female connector, B is an insertion detecting member for terminal lugs (terminal metal parts).

The female connector A comprises a housing body portion A1 and a hood portion A2 extended at the front thereof through a step portion A3. A plurality of terminal accommodating cavities 1 are provided in two tiers in the housing body portion A1, each of the terminal accommodating cavities 1 containing a stopper 2 at the front end thereof, and a cantilevered resilient locking piece 3 extending forward through a support base 3*a* at the bottom thereof. A locking projection 3*b* is provided at the front free end of the resilient locking piece 3. A resilient displacement permitting space 4 is formed below the resilient locking piece 3.

A locking frame portion 5 is provided at an upper portion of the hood portion A2. A locking portion 5' is formed at the open rear end of the locking frame portion 5.

The terminal-lug insertion detecting member B has a main frame portion 6 of longitudinally small width and a plurality of insertion detectors 7 in two rows at intermediate and lower portions of the main frame portion, extending forward corresponding to the resilient displacement permitting spaces 4. The main frame portion 6 further has a pair of manipulating portions 8 extending forward at both sides thereof and a resilient locking arm 9 extending forward at the upper end thereof. The resilient locking arm 9 has a provisional locking projection 9*a* at the front end, and a full locking projection 9*b* at an intermediate portion thereof.

In the above construction, the insertion detecting member B is in advance inserted into the hood portion A2 while sliding the main frame portion 6 along inner surfaces of the hood portion A2, and coupled to the female connector A in a provisional locking position in which the provisional locking projection 9*a* of the resilient locking arm 9 engages the locking portion 5'. At this time, the pair of manipulating portions 8 are exposed at the opposite sides of the housing body portion A1 through respective windows 10 (refer to FIG. 1) in the step portions A3 (refer to FIG. 2A).

In the provisional locking position, terminal lugs C are inserted into terminal accommodating cavities 1 from the rear of the housing body A1. At this time, the terminal lug C is inserted while displacing the resilient locking piece 3 into the resilient displacement permitting space 4. On completion of the insertion of the terminal lug C, the resilient locking piece 3 restores its original position to bring its locking projection 3*b* into engagement with a shoulder portion 11 of the terminal lug C and thereby prevent the terminal lug C from slipping off from the rear (refer to FIG. 2B).

Next, a users thumb and first finger are put on the exposed pair of manipulating portions 8 to pull the insertion detecting member B into full locking position with the female connector A in which the full locking projections 9*b* engage the locking portion 5' of the female connector. In the full locking position, the insertion detector 7 enters into the resilient displacement permitting space 4, thereby to obstruct the displacement of the resilient locking piece 3 and ensure that the terminal lug C does not slip off from the rear (refer to FIG. 3B).

In case the terminal lug C is inserted incompletely, since the resilient locking piece 3 is positioned inside the resilient displacement permitting space 4, the insertion detector 7 is disabled from moving into the resilient displacement permitting space 4 so that the insertion detecting member B can not move into its full locking position, thereby making it possible to detect that the terminal lug C is in incompletely inserted condition.

Figure 4:
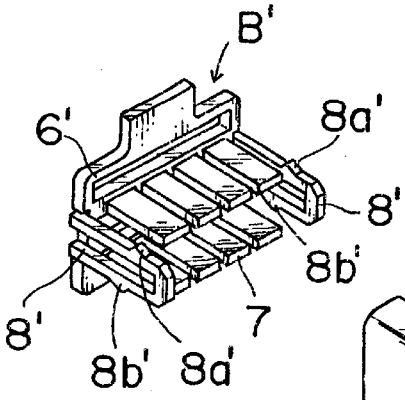
FIG. 4 is a perspective view of a connector and an insertion detecting member according to another embodiment of the present invention, shown separated.
Figure 5:
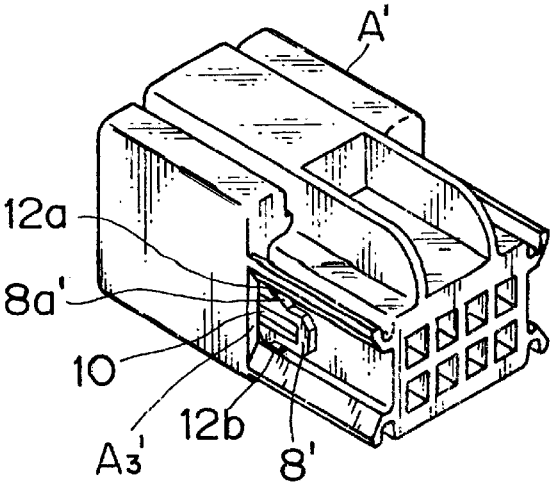
FIG. 5 is a perspective view of the insertion detecting member of FIG. 4, shown in a provisional locking position.
Figure 5:
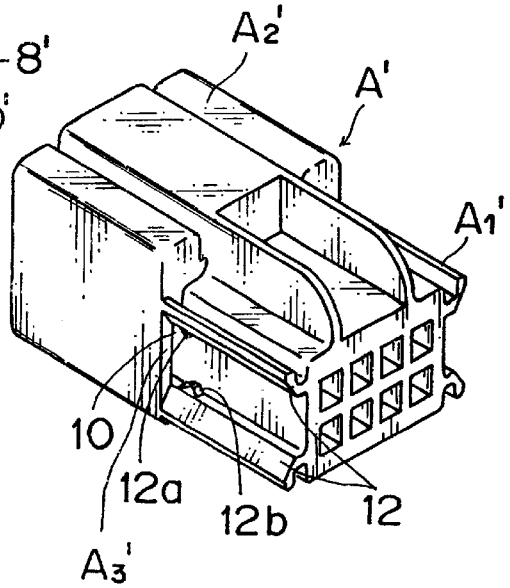
Figure 6:
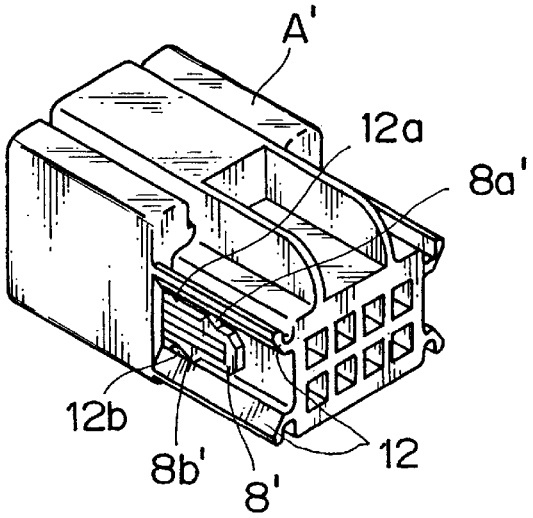
FIG. 6 is a perspective view of the insertion detecting member of FIG. 4, shown in its full locking position.

In the construction as shown in FIGS. 4 to 6, the manipulating portions 8' at opposite sides of a main frame portion 6' of an insertion detecting member B is each formed as a resilient frame body comprised of vertically opposed resilient deformable portions 8*a*" and 8*b*" with a resilient displacement permitting space S formed therebetween. Each resilient deformable frame portion 8*a*" is formed with a roughly triangular provisional locking projection 8*a*' and each resilient deformable frame portion 8*b*" with a full locking projection 8*b*', the provisional locking projection 8*a*' being located at a position closer to the distal end of the resilient frame body 8'. Guide ribs 12 on each side wall of a housing body A1' are provided with respective roughly triangular provisional and full locking projections 12*a* and 12*b*.

FIG. 5 shows the insertion detecting member B' coupled in a provisional locking position to the female connector A', in which the manipulating portions 8', 8' are exposed at opposite sides of the housing body portion A1' through respective windows 10 provided in the step portions A3', A3'. To be put in provisional locking position, the provisional locking projection 8*a*' of the manipulating portion 8' abuts against the provisional locking projection 12*a* formed on the upper guide rib 12, deforms the resilient deformable frame portion 8*a*" into the resilient displacement permitting space S, and rides over the provisional locking projection 12*a* to engage therewith.

Fingers are then put on the pair of manipulating portions 8' to move the insertion detecting member B', at which the resilient deformable frame portion 8*b*" is deformed into the resilient displacement permitting space S to allow the full locking projections 8*b*' and 12*b* to engage with each other, thereby to put the insertion detecting member B' in full locking position.

Figure 7A:
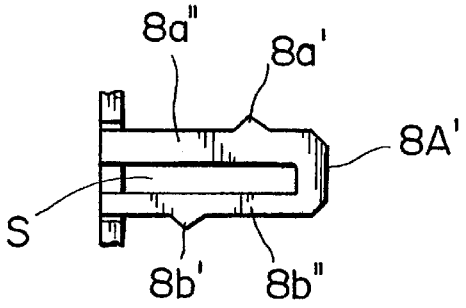
FIGS. 7A and 7B are side views of manipulating portions according to other embodiments of the present invention.
Figure 7B:
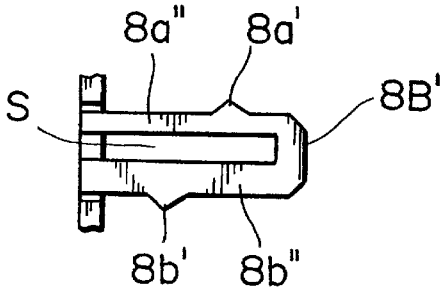
Figure 8:
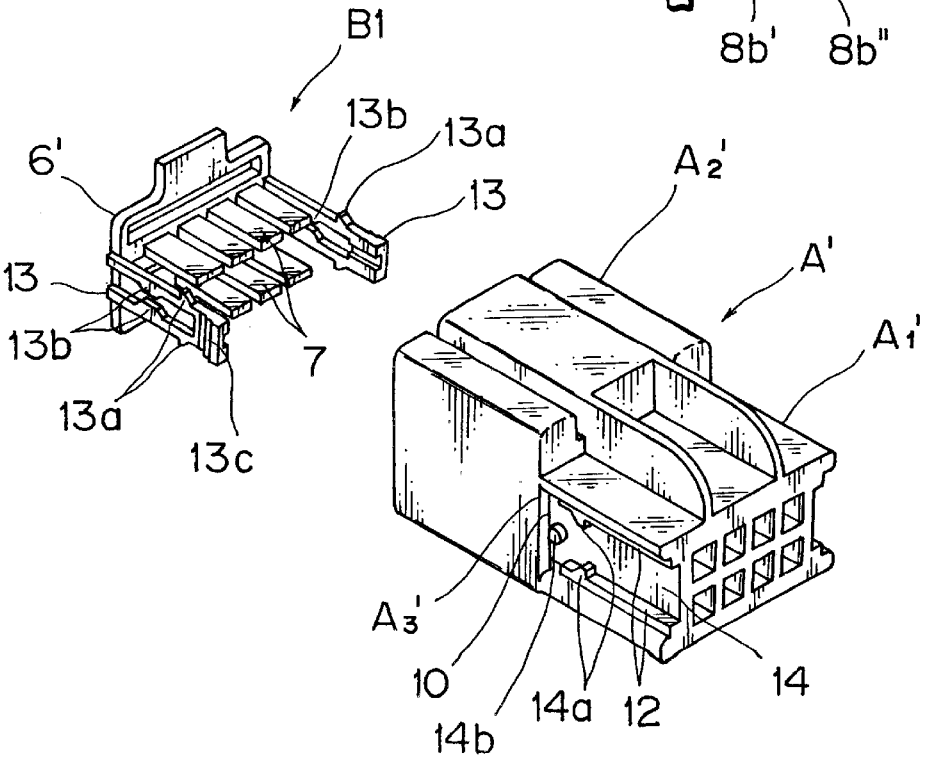
FIG. 8 is a perspective view of a connector and an insertion detecting member according to a further embodiment of the present invention, shown separated.

FIG. 7A shows a manipulating portion 8A' with an increased provisional locking force, which is obtained by enlarging the arm thickness of the upper resilient deformable frame portion 8*a*" with the provisional locking projection 8*a*' to intrude into the resilient displacement permitting space, and FIG. 7B shows a manipulating portion 8B' with an increased full locking force, which is obtained by enlarging the arm thickness of the lower resilient deformable frame portion 8*b*" with the full locking projection 8*b'*.

The force with which an insertion detecting member, double locking member or the like is locked to a connector housing is generally adjusted by a) adjustment of engagement height by changing the height of a locking projection, b) adjustment of engagement angle by changing the angle of the engagement surface of a locking projection, c) adjustment of arm repulsion by changing the width of a locking arm, and d) adjustment of arm repulsion by changing the thickness of a locking arm. The adjustment of locking force in these cases, however, requires not only the modification of locking projections or arms on the part of a member to be locked such as an insertion detecting member, but also the modification of engaging portions on the part of the connector housing, resulting in a disadvantage that an additional cost is required for modifying the dies for producing the connector housing.

In contrast, in the present invention, the provisional and full locking forces can be adjusted by modifying in thickness, or the like, the resilient deformable frame members 8*a*", 8*b*" of the resilient frame body 8A', 8B' through the inside resilient displacement permitting space S, and thus only by modifying the insertion detecting member B'.

In the construction as shown in FIGS. 8 to 11, the manipulating portions 13 in the form of resilient frame bodies at opposite sides of the main frame portion 6' of an insertion detecting member B1 each comprises a pair of upper and lower resilient deformable frame portions 13' with a resilient displacement permitting space S formed therebetween. Provisional locking projections 13*a*, 13*a* are formed at outer sides of the pair of upper and lower frame portions 13' towards their free end to be symmetrical relative to a center line L1 of the manipulating portion 13. Full locking projections 13*b*, 13*b* are formed at inner sides of the frame portions 13' at positions towards a step portion A3', which positions are symmetrical relative to the center line L1. A pair of opposed provisional locking projections 14*a*, 14*a* are formed at the guide ribs 12 on the side wall outer surface 14 of the housing body A1'. A columnar full locking projection 14*b* is provided on the center line L1 at a position towards the step portion A3'. The provisional locking projection 13*a* is formed with a tapered engagement guide surface 13*a*1 at the front in the direction of its advancement and with a vertical engagement surface 13*a*2 at the rear. The full locking projection 13*b* is formed with a tapered engagement guide surface 13*b*1 at the front in the direction of its advancement and with a tapered engagement surface 13*b*2 at the rear. Further, the provisional locking projection 14*a* of the housing body A1' is formed with a vertical engagement surface 14*a*1 at the rear in the direction of front and back of the housing body A1' and with a tapered engagement guide surface 14*a*2 at the front. Denoted 13*c* is a finger-manipulating portion.

Figure 9:
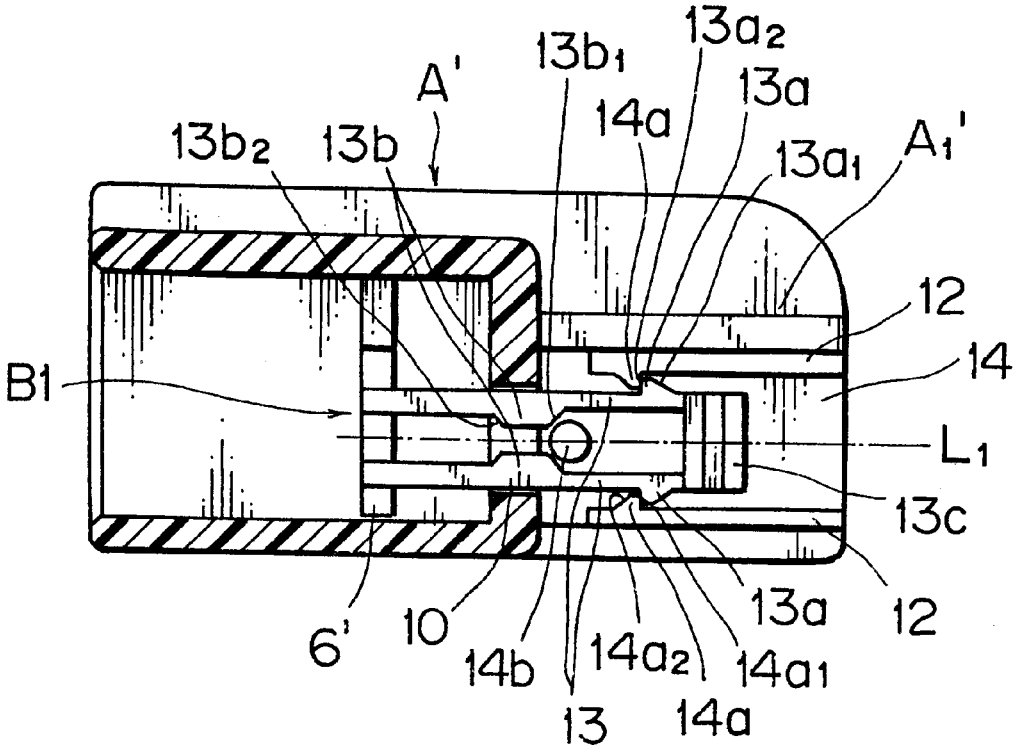
FIG. 9 is a side view of the insertion detecting member of FIG. 8, shown in provisional locking position.

In the above construction, in the provisional locking position of the insertion detecting member B1, the provisional locking projections 13*a*, 13*a* of the manipulating portion 13 engage the provisional locking projections 14*a*, 14*a* provided on the guide ribs 12 (refer to FIG. 9).

Figure 10:
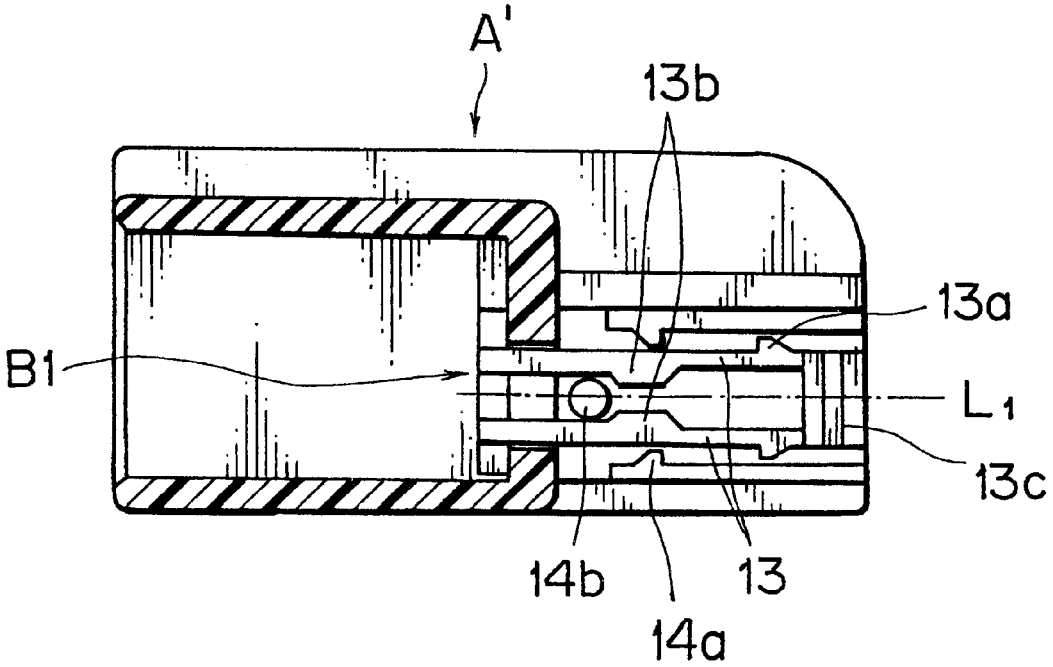
FIG. 10 is a side view of the insertion detecting member of FIG. 8, shown in full locking position.

Fingers are then put on the manipulating portion 13*c* to further pull the insertion detecting member B1 out, at which the pair of full locking projections 13*b*, 13*b* contact and ride over the full locking projection 14*b* while deforming themselves in upward and downward directions, and restore their original position to put the insertion detecting member B1 in fully locking position (refer to FIG. 10).

In the above construction, since the pairs of provisional locking projection 13*a*, 13*a* and of full locking projections 13*b*, 13*b* of the manipulating portion 13 are provided symmetrical to each other relative to the center line L1, the manipulating portion 13 is stably moved without inclinations, and the construction of the full locking projection 14*b* on the housing body A1' is simplified.

Figure 11:
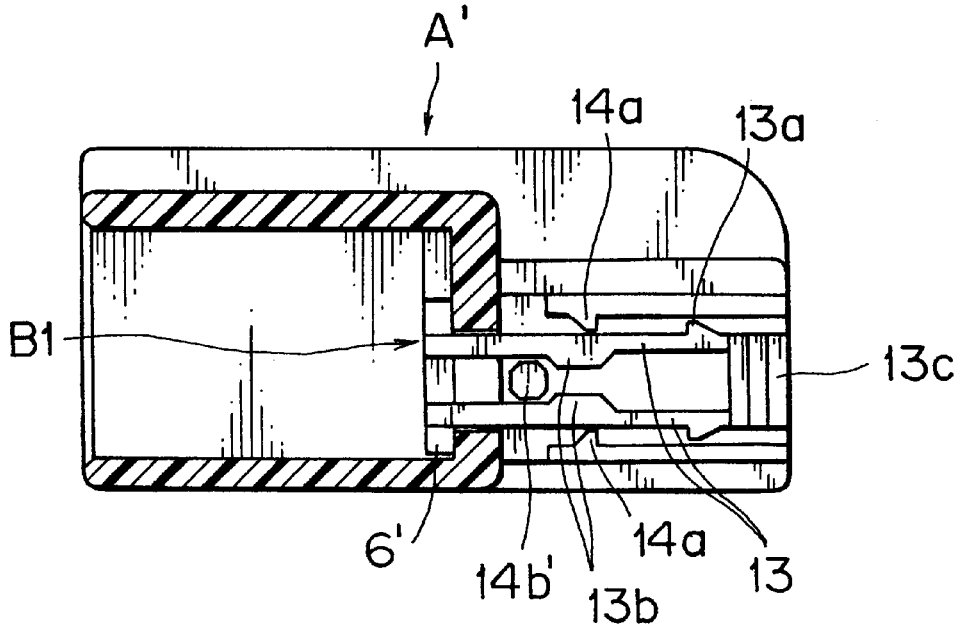
FIG. 11 is a side view of an insertion detecting member according to another embodiment of the present invention.
Figure 12:
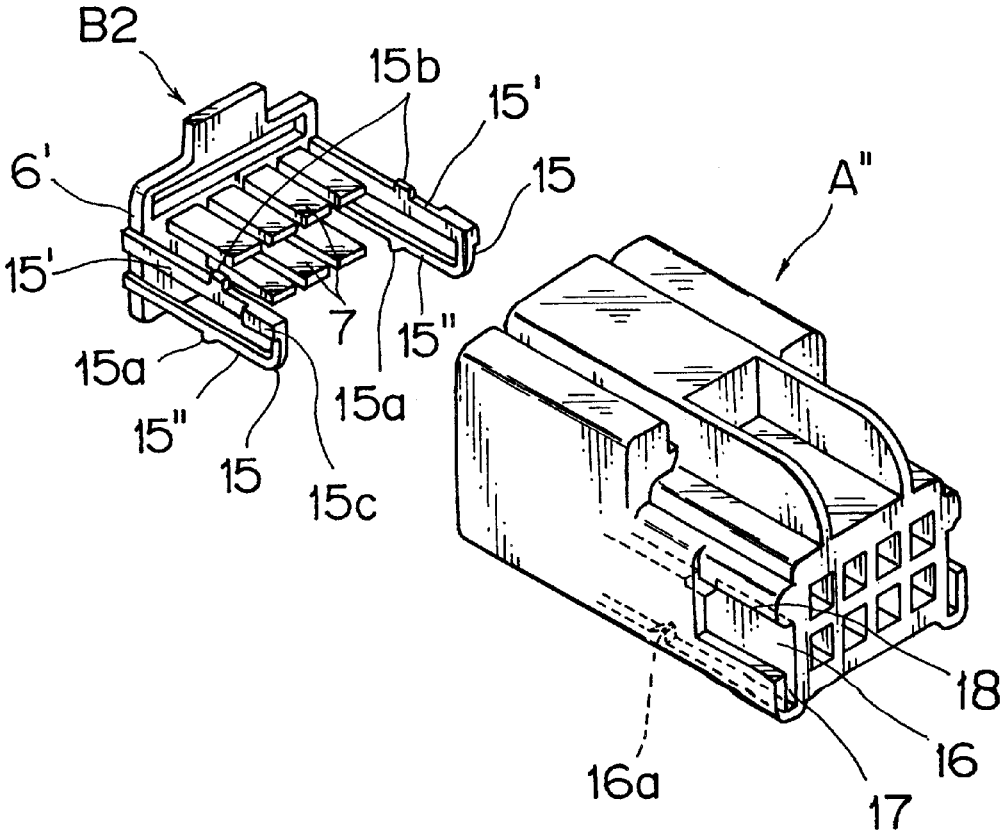
FIG. 12 is a perspective view of a connector and an insertion detecing member according to a yet another embodiment of the present invention, shown separated.

In the construction as shown in FIG. 11, the full locking projection 14*b'* at the side wall outer surface 14 of the housing body A1' is provided in the shape of an octagonal rod, and by properly setting the tapered angle of the engagement guide surface 13*b*1 of the full locking projection 13*b* of the insertion detecting member B1, an optional insertion force and insertion feeling can be obtained.

In the construction as shown in FIGS. 12 to 16, the manipulating portions 15 in the form of frame bodies at opposite sides of the main frame portion 6' of an insertion detecting member B2 each comprises a shape-keeping frame portion 15' at an upper half thereof and a resilient deformable frame portion 15" at a lower half, with a resilient displacement permitting space S formed therein. A provisional locking projection 15*a* is formed at an outer side of each resilient deformable frame portions 15". A full locking projection 15*b* is formed at an outer side of the shapekeeping frame portion 15'. Inside a supporting groove 17 extending longitudinally at a lower portion of the side wall outer surface 16 of the housing body A1 of the female connector A" is formed a provisional locking projection 16*a*, and on a step portion 18 provided at an upper portion of the side wall outer surface 16, opposite to the supporting groove 17 is formed a full locking projection 16*b*.

In the insertion detecting member B2, the provisional locking projection 15*a* is formed with a tapered engagement guide surface 15*a*1 at the front in the direction of its advancement and with a vertical engagement surface 15*a*2 at the rear. The full locking projection 15*b* is formed with vertical engagement surfaces 15*b*1 and 15*b*2 at the front and rear, respectively.

The provisional locking projection 16*a* of the housing body A1" is formed with a vertical engagement surface 16*a*1 at the rear in the direction of front and back of the housing body A1" and with a tapered engagement guide surface 16*a*2 at the front. The full locking projection 16*b* is formed with vertical engagement surfaces 16*b*1, 16*b*2 at the front and rear. At the end of the shape-keeping frame portion 15 is formed a finger-manipulating portion 15*c*.

Figure 13:
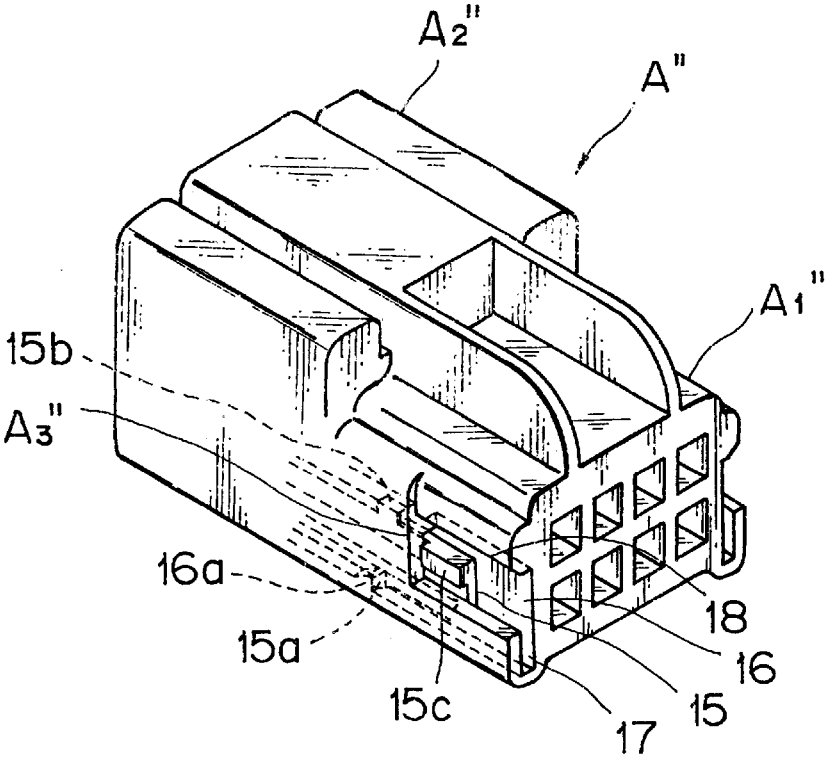
FIG. 13 is a perspective view of the insertion detecting member of FIG. 12, shown in provisional locking position.
Figure 15:
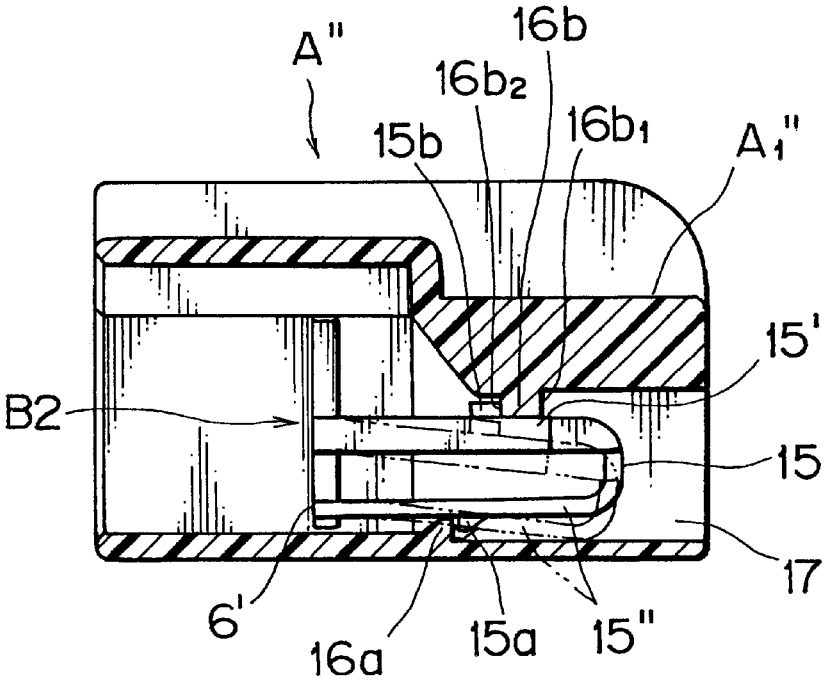
FIG. 15 is a side view of the insertion detecting member of FIG. 12, shown in provisional locking position.

In the above construction, in the provisional locking position of the insertion detecting member B2, the provisional locking projection 15*a* of the resilient deformable frame portion 15" exposed at the side wall outer surface 16 through the window 10 in the step portion A3" engages the vertical engagement surface 16*a*1 of the provisional locking projection 16*a* of the housing body A1", while at the same time the full locking projection 15*b* of the rigid frame portion 15' engages the vertical engagement surface 16*b*2 of the full locking projection 16*b* of the housing body A1" (refer to FIGS. 13 and 15).

Figure 14:
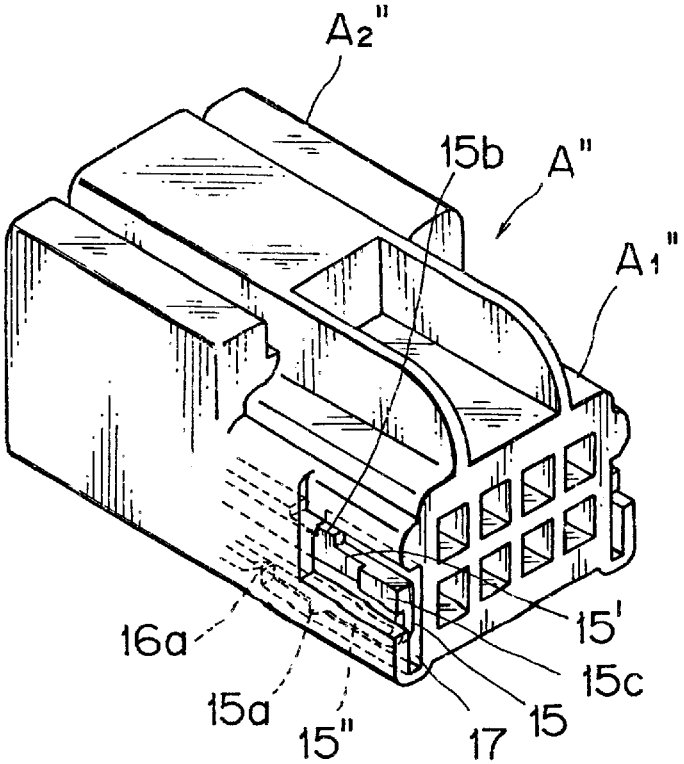
FIG. 14 is a perspective view of the insertion detecting member of FIG. 12, shown in full locking position.
Figure 16:
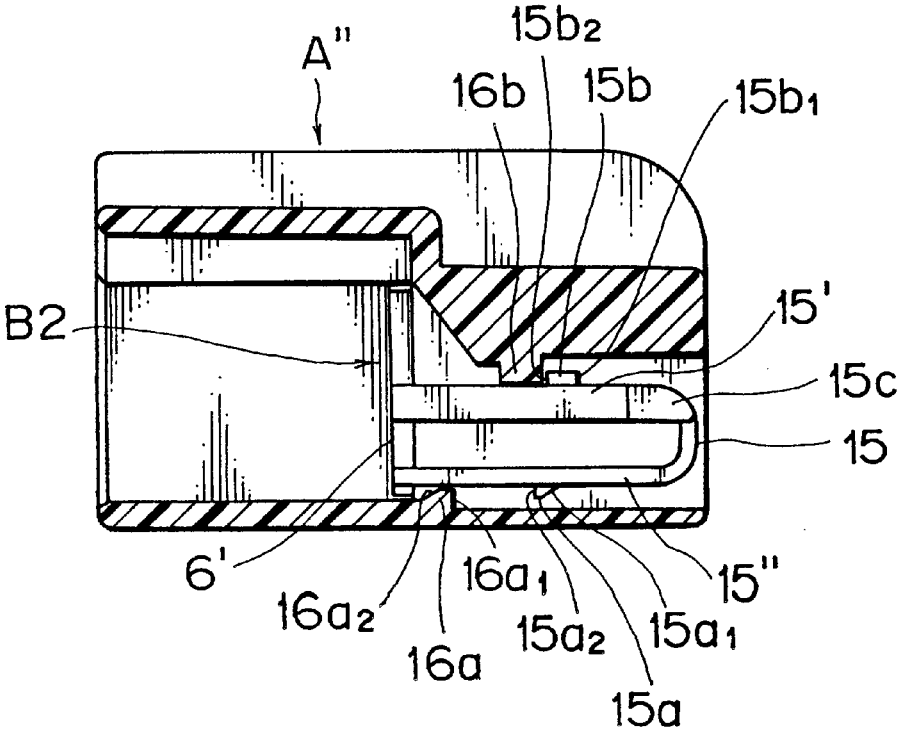
FIG. 16 is a side view of the insertion detecting member of FIG. 12, shown in full locking position.
Figure 17:
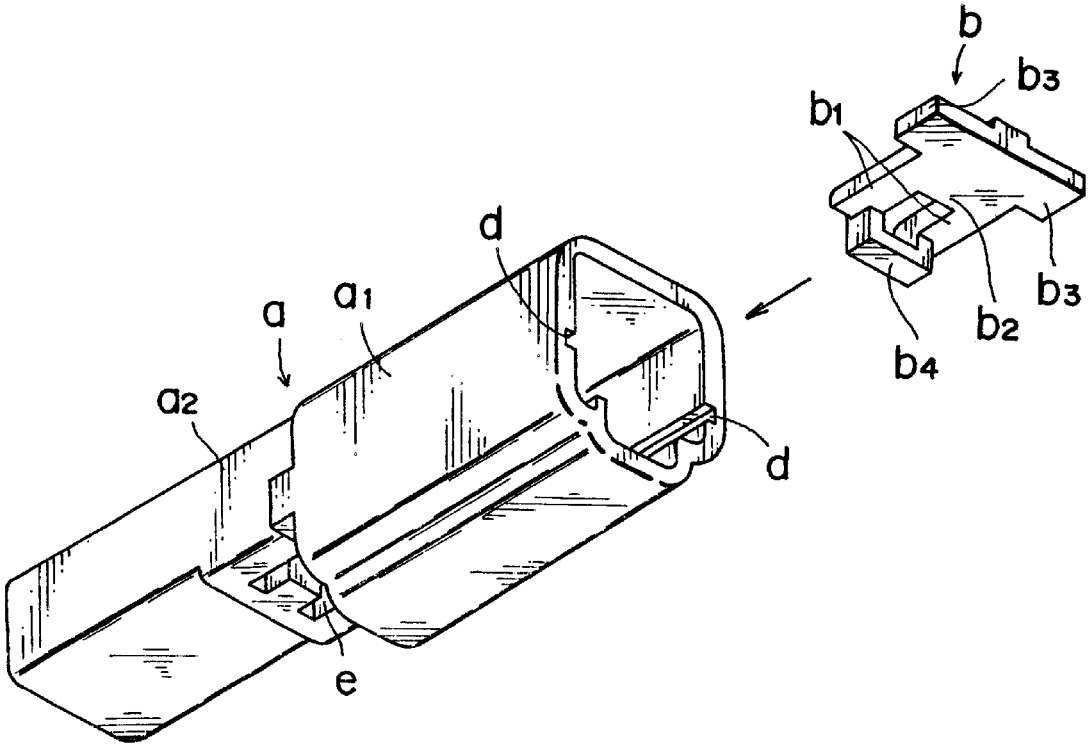
FIG. 17 PRIOR ART
FIG. 17 is a perspective view of conventional connector and insertion detecting member, shown separated.
Figure 18:
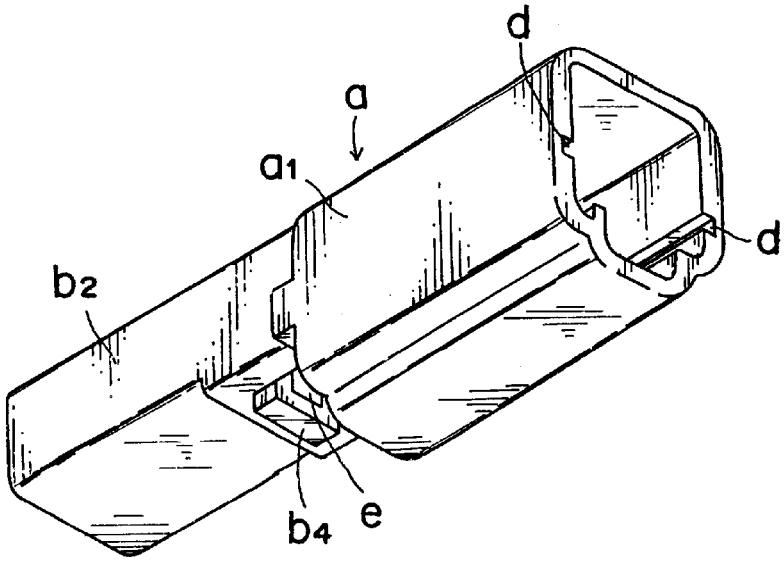
FIG. 18 PRIOR ART
FIG. 18 is a perspective view of the insertion detecting member of FIG. 17, shown in provisional locking position.
Figure 19:
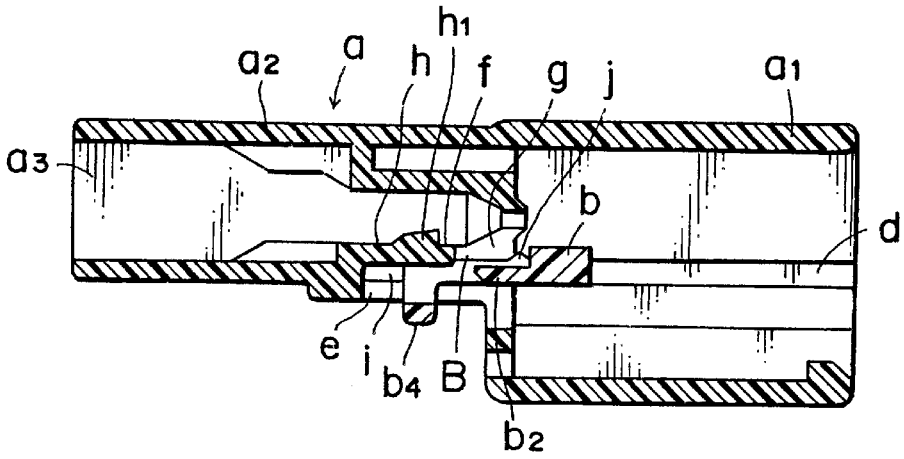
FIG. 19 PRIOR ART
FIG. 19 is a sectional view taken along an insertion axis direction of FIG. 17.
Figure 20:
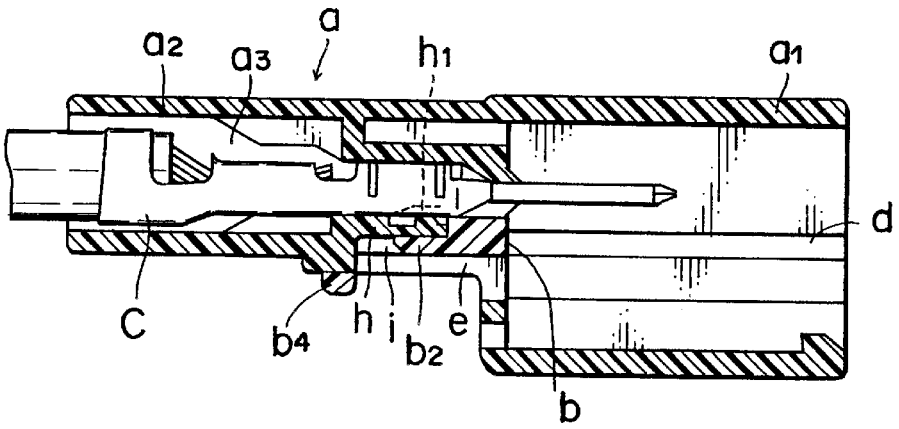
FIG. 20 PRIOR ART
FIG. 20 is a sectional view of the insertion detecting member of FIG. 17, shown in full locking position.
Figure 21:
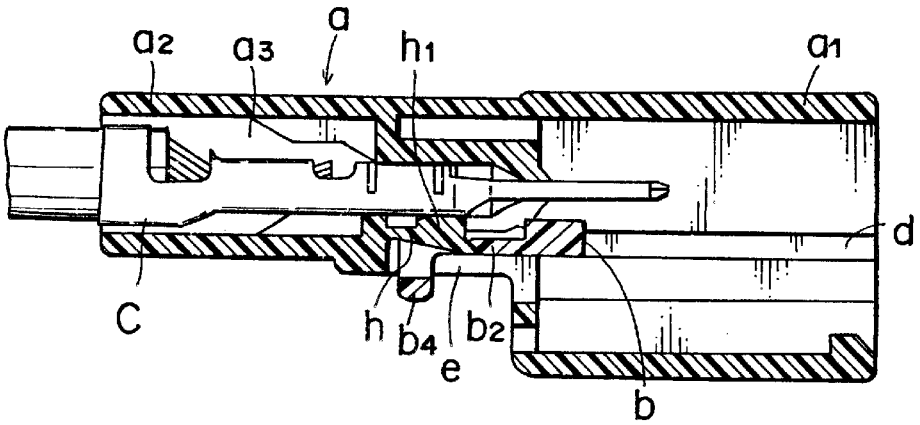
FIG. 21 PRIOR ART
FIG. 21 is a sectional view showing a terminal lug inserted incomplete in the conventional connector.

Fingers are then put on the manipulating portion 15*c* to further pull the manipulating portion 15 out while pushing the same downwardly, at which the resilient deformable frame portion 15" is readily deformed by the pushing to allow the full locking projection 15*b* to ride over the full locking projection 16*b*, restore its original position when the pushing is released, and engage the vertical engagement surface 16*b*1 so that the insertion detecting member B2 is put in full locking position (refer to FIGS. 14 and 16).

In the above construction, the manipulating portion includes the shape-keeping frame portion and the resilient deformable frame portion, and by providing the full locking projection on the rigid frame portion, a reliable locking performance is obtained, while the movement of the insertion detecting member B2 from provisional locking position to full locking position is facilitated by the resilient deformable frame portion.

As described above, according to the present invention there are provided an connector equipped with an hood portion in front thereof, and the insertion detecting member for terminal metal parts provided movably from the provisional engaging position to the complete engaging position in the hood portion. The resilient engaging piece to the terminal metal part is moved into the resilient displacement permissible space opposite the terminal accommodating cavity formed in the connector body portion of the connector. There are provided the insertion detecting body corresponding to in shape the resilient displacement permissible space at the main frame portion of the insertion detecting member for terminal metal parts and the pair of manipulating pieces at both sides thereof. The insertion detecting member for terminal metal parts is caused to have the main frame portion come into contact with the inside wall surface of the hood portion, moving freely. The pair of manipulating pieces are exposed on both sides of the housing body portion extruding from the window of the hood portion at the provisional engaging position, the insertion detecting body enters into the resilient displacement permissible space at the complete engaging position, therefore it is not necessary to enlarge the housing to keep the strength of hood portion. The insertion detecting member for terminal metal parts is capable of being moved within the hood portion, and the insertion detecting member for terminal metal parts of the provisional engaging position to move smoothly toward the formal engaging position, being moved by the pair of the manipulating portions.

Further, since in the present invention the manipulating piece is comprised of a resilient frame body having engaging projections formed thereon and a resilient displacement space formed therein for the resilient frame body, the engaging force to the connector housing can be adjusted by changing the thickness or the like of the resilient frame body through the utilization of the resilient displacement space, i.e., only by a design change to the part of the insertion detecting member for terminal metal parts. Besides, provisional and full engaging forces can be separately adjusted.

Further, owing to the fact that in the present invention the frame-shaped manipulating portion is comprised of a rigid frame portion and a resilient displacement frame portion, and full and provisional engaging projections are provided on the rigid frame portion and resilient displacement frame portion, respectively, the movement of the terminal lug insertion detecting member from the provisional engaging position to the full engaging position is facilitated, leading to an ensured full engagement.

Having now fully described the invention, it will be apparent to one of ordinary skill in the art that many changes and modifications can be made thereto without departing from the spirit and scope of the invention as set forth herein.

What is claimed is:

1. A connector equipped with an insertion detecting member for terminal lugs, comprising:

a connector housing having a body portion and containing walls defining a hood portion disposed adjacent said body portion and communicating therewith, the walls of said hood portion having greater peripheral dimensions than said housing body portion and being interconnected therewith on laterally opposite sides of said housing body portion by a step portion containing a window, said body portion of the connector housing having terminal-accomodating cavities formed therein, each having a resilient, terminal-lug locking piece projecting therein to form a resilient displacement-permitting space on a side opposite a side where said thermal lug is inserted;

an insertion detecting member for terminal lugs provided in said hood portion of the connector housing, said insertion detecting member including a main frame portion, insertion detectors corresponding to said resilient displacement permitting spaces provided on said main frame portion, and a pair of manipulating portions provided at opposite sides of said main frame portion, and arranged to leave ends extending to an exposed position through said windows when said insertion detecting member is installed in said hood portion, said insertion detectors and said manipulating portions extending in a coupling direction of said insertion detecting member to said hood portion, said manipulating portions each comprising a resilient frame body having elongated, substantially parallel, mutually spaced, resiliently deformable frame portions and a resilient displacement-permitting space formed therebetween, wherein a provisional locking projection is provided on one of said resiliently deformable frame portions and a full locking projection is provided on the other of said resiliently deformable frame portions, and wherein one of said resiliently deformable frame portions is less resilient than the other resiliently deformable frame portion for increasing the locking force generated by said lens resilient frame portion, wherein said insertion detecting member is moveable from a provisional locking position to a full locking position inside said hood portion, with said main frame portion slidable along inner surfaces of said hood portion, and wherein, in said provisional locking position, said pair of manipulating portions are exposed at opposite sides of said body portion of the connector housing through said windows provided in said hood portion, and in said full locking position said insertion detectors move into said respective resilient displacement-permitting spaces of said terminal-lug locking pieces, and wherein said less resilient resiliently deformable frame portion is dimensionally enlarged relative to said other resiliently deformable frame portion by extending the thickness of the enlarged resiliently deformable frame portion into said resilient displacement permitting space between said deformable frame portions of said resilient frame body.

2. The connector according to claim 1 wherein said dimensionally enlarged frame portion contains said provisional locking projection.

3. The connector according to claim 1 wherein said dimensionally enlarged frame portion contains said full locking projection.

4. The connector according to claim 1, wherein said manipulating portions each comprise a frame body with a resilient displacement permitting space formed therein, said frame body including a rigid frame portion and a resilient deformable frame portion, and wherein a provisional locking projection is provided on said resilient deformable frame portion and a full locking projection is provided on said rigid frame portion so that said provisional and full locking projections engage with said housing body portion to put said insertion detecting member in said provisional and full locking positions, respectively.

* * * * *